United States Patent [19]

Taitel et al.

[11] Patent Number: 4,659,074

[45] **Date of Patent: * Apr. 21, 1987**

[54] PASSIVE-TYPE TREADMILL HAVING AN IMPROVED GOVERNOR ASSEMBLY AND AN ELECTROMAGNETIC SPEEDOMETER INTEGRATED INTO THE FLYWHEEL ASSEMBLY

[75] Inventors: Charles M. Taitel; Janice B. Taitel, both of Parsippany, N.J.

[73] Assignee: Landice Products, Inc., Dover, N.J.

[ * ] Notice: The portion of the term of this patent subsequent to Oct. 1, 2002 has been disclaimed.

[21] Appl. No.: 711,844

[22] Filed: Mar. 14, 1985

[51] Int. Cl.[4] ..... A63B 23/06

[52] U.S. Cl. ..... 272/69; 188/72.7; 188/187; 188/218 A

[58] Field of Search ..... 272/69, 73, 96, 131, 272/132; 128/25 R; 188/72.7, 187, 218 A, 72.8

[56] References Cited

U.S. PATENT DOCUMENTS

| | | | |
|---|---|---|---|
| 3,424,288 | 1/1969 | Sink | 188/218 A |
| 3,995,491 | 12/1976 | Wolfla, II | 272/73 |
| 4,544,152 | 1/1985 | Taitel | 272/69 |
| 4,561,533 | 12/1985 | Roseto | 188/218 A |

*Primary Examiner*—Richard J. Apley
*Assistant Examiner*—S. R. Crow
*Attorney, Agent, or Firm*—Louis Weinstein

[57] ABSTRACT

A passive treadmill having a governor mounted upon one end of a treadmill roller to adjustably limit the rate of speed of the treadmill belt. Resilient flexible rotating springs flex due to the centrifugal force developed during rotation, the magnitude of the centrifugal force being a function of the linear speed of the treadmill belt. Arcuate shaped brake pads mounted on integral projections of the flexible springs move into sliding engagement with an annular stationary surface to limit the linear speed of the treadmill belt. A rotatably mounted cam is manually adjustable to adjust the spacing between the aforesaid slidably engagable surfaces to adjust the operating speed. A stabilizing ring arranged between the governor springs prevents the projections from resonant non-uniform flexing.

Support rollers rollingly support the treadmill belt, and are rotatably mounted within elongated openings provided in each of a pair of mounting rails. An adjustment roller having an hour-glass configuration is swingably mounted beneath the belt support rollers. The adjustment roller is pivoted at one end and its opposite end may be releaseably positioned within one of a plurality of positioning notches to compensate for irregularities of the belt. A fully passive speedometer assembly cooperates with a flywheel mounted upon the opposite end of the first-mentioned treadmill roller for providing a reading of the linear speed of the treadmill belt.

The treadmill may alternatively be provided with a plurality of rollers intermediate the forward and rearward rollers for supporting the belt or may have a sliding bed and guides for maintaining the sliding belt in proper alignment.

10 Claims, 25 Drawing Figures

22
14c
16e
14
16
146a, 146b
146c
147
146e
146d
146
14e
12
142
142a
142b
14f'
14g'
14h'
14'
144
149
119
120
122
18a
126
130
14a
14a-1
122a
14
146
146a
146c
146e
146b
146d
12a
12
16

PASSIVE-TYPE TREADMILL HAVING AN IMPROVED GOVERNOR ASSEMBLY AND AN ELECTROMAGNETIC SPEEDOMETER INTEGRATED INTO THE FLYWHEEL ASSEMBLY

FIELD OF THE INVENTION

The present invention relates to treadmills, and more particularly, to treadmills of the passive type, typically employed for exercise purposes and including a flywheel and a governor having axially adjustable, flexible rotating blades axially movable by an adjustment cam and cooperating with a stationary surface for limiting the linear velocity of the treadmill belt which engages the roller coupled to the flexible blades of the governor, and further including method and apparatus for maintaining the treadmill belt centered upon support rollers in a simiplified manner. A passive electromagnetic speedometer is integrated into the treadmill governor.

BACKGROUND OF THE INVENTION

Treadmills are presently utilized as advantageous means for performing vigorous exercise indoors or in confined areas and at a stationary position. Such treadmills are typically comprised of an elongated closed-loop belt supported by a plurality of rotatable rollers arranged at closely-spaced parallel intervals and being mounted in a freewheeling manner. In order to limit the linear speed of the belt, it is typical to provide a flywheel. The user operates a control on the treadmill rail to control speed. Only one known passive treadmill employs a governor which is both complicated and expensive. It is, therefore, desirable to provide a governor for treadmills and the like which is simple to use and having a simplified and yet rugged and reliable design to enable rapid adjustment of the treadmill linear speed. A suitable design to accomplish these objectives is set forth in copending application Ser. No. 517,079 filed July 25, 1983. This design however has been found to have certain disadvantages.

The governor assembly described in the aforementioned application utilizes a flexible blade-like member arranged to rotate about its center and provided at opposite ends thereof with a disk-shaped brake pad, for slidable engagement with a cooperating stationary annular surface. A second blade is arranged behind the first blade and secured to the first blade by spacer means. The pair of blades cooperate to provide a resilient flexible blade assembly. In operation, the blades have been found to resonant or vibrate causing irregularities in the governor assembly as well as an ineffective braking force.

A speedometer typically provided with the treadmill is mechanically secured to one of the rotating members for indicating the linear speed of the belt, imposing a drag upon the treadmill. Also, there is no means for compensating for irregularities of the treadmill belt.

DESCRIPTION OF THE INVENTION

The treadmill of the present invention is characterized by comprising a novel governor having a plurality of flexible springs each formed of spring steel and provided with a plurality of radially aligned projections. Two pairs of governor springs are provided with each pair comprising first and second governor springs positioned one against the other. Spacer means are arranged between the two pairs of governor springs to maintain the pairs of governor springs in spaced alignment. Arcuate shaped brake pads are joined to the outer ends of each projection of one of said pairs of governor springs for slideable engagement with a cooperating stationary annular surface with the engaging force being a function of the angular velocity of the rotating governor springs and hence the linear speed of the belt. A metallic stabilizing ring is arranged between the first and second pairs of governor springs for preventing non-uniform resonant flexing of the projections as they rotate.

A one-piece cam member arranged for swingable movement along the surface of a spider enclosing the governor is swingably adjustable between two extreme positions controlled by a portion of the cam extending through an arcuate slot in the surface of said spider to position a portion of the diagonally aligned cam surface to control the separation distance between the brake pads and the cooperating stationary annular surface when the treadmill governor springs are not rotating.

A passive speedometer system is provided which is comprised of permanent magnets arranged at spaced intervals about the treadmill flywheel member. A sensor is mounted upon the treadmill adjacent to the flywheel member for generating an electrical signal which varies as a function of the rotating speed of the flywheel as the permanent magnets pass the sensor means. The output signal of the sensor means is converted to a D.C. signal by suitable diode means and a stabilizing capacitor for generating a substantially D.C. signal whose magnitude is a function of the angular velocity of the flywheel. The converted signal as coupled to a meter arranged on the treadmill control panel for providing a reading which directly represents the miles per hour (m.p.h.) of the treadmill belt. The passive type system does not impose any drag upon the treadmill and further eliminates the need for coupling the electrical speed indicating system to a source of power in the form of either batteries or a source of local household current.

In order to compensate for irregularities of the belt, an hourglass-shaped belt adjustment roller is swingably mounted beneath the belt supporting rollers. A first end of the adjustment roller shaft is pivotally mounted to enable the adjustment roller to be swingably moved. A positioning plate provided with a plurality of notches arranged at spaced intervals is designed to releasably receive the opposite end of the adjustment roller shaft in one of said notches for maintaining the adjustment roller in a particular angular orientation relative to the belt support rollers to compensate for belt irregularities. The belt is entrained about the support rollers and the adjustment roller and serves to maintain the selected position of the roller within a selected one of the downwardly extending notches.

In an alternative embodiment the rollers intermediate the opposite end rollers are replaced by a slider bed comprising a stationary board. The belt slides along the top surface of the slider bed. Belt guides may be provided to guide the belt and maintain it in proper alignment.

OBJECTS OF THE INVENTION AND BRIEF DESCRIPTION OF THE FIGURES

It is, therefore, one object of the present invention to provide a novel governor for use in treadmill assemblies and the like, said governor employing axially positionable flexible rotating governor springs having projections adapted to experience substantially linear movement in a direction parallel to the rotational axis of the projections and further including adjustable one-piece cam means for controlling the position of said governor springs along their longitudinal axis to adjust the position of the brake pads carried by the projections relative to a cooperating stationary annular surface, and thereby control and limit the linear speed of the treadmill belt.

Still another object of the present invention is to provide a treadmill assembly incorporating a plurality of belt support rollers supported by the roller support sections of a pair of rails, and a swingably mounted adjustment roller cooperating with a positioning plate for compensating for irregularities of the treadmill belt.

Still another object of the present invention is to provide a treadmill assembly of the character described in which a novel passive electromagnetic type speedometer is provided.

Another object of the present invention is to provide a treadmill assembly incorporating a stationary slider bed and guide means for properly guiding the movement of the belt.

The above as well as other objects of the present invention will become apparent when reading the accompanying description and drawings in which.

Figure 2A:
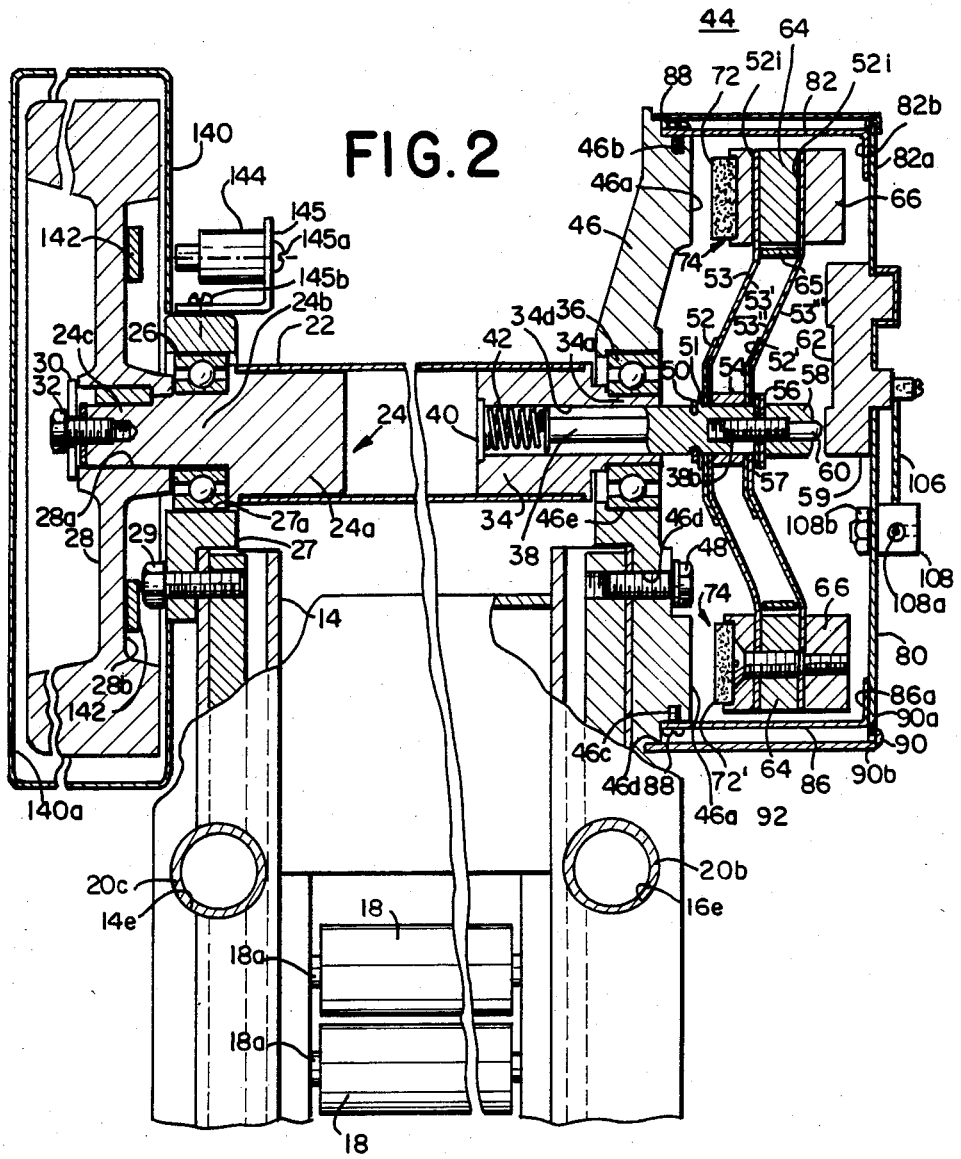
FIG. 2 shows a broken, detailed, top plan view of the treadmill assembly of FIG. 1, in which portions thereof are sectionalized for facilitating the understanding of the present invention.
Figure 2A:
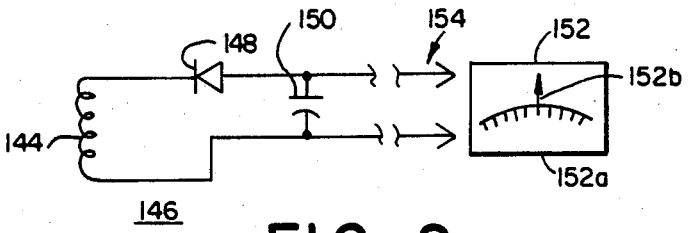

FIG. 2*a* is a schematic diagram of the passive speedometer of FIG. 2.

Figure 3A:
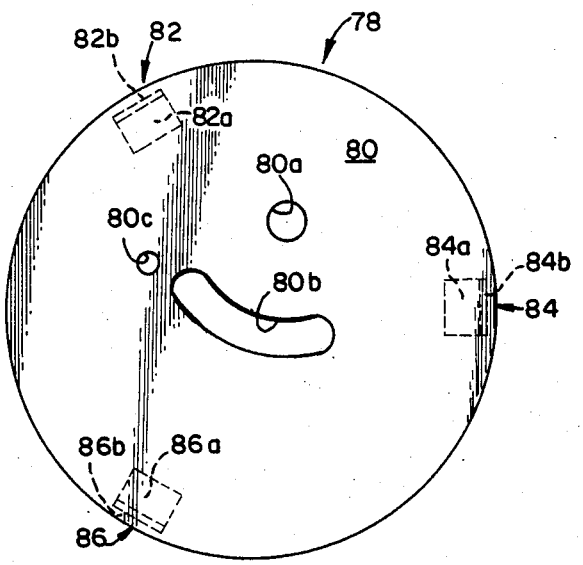
Figure 3B:
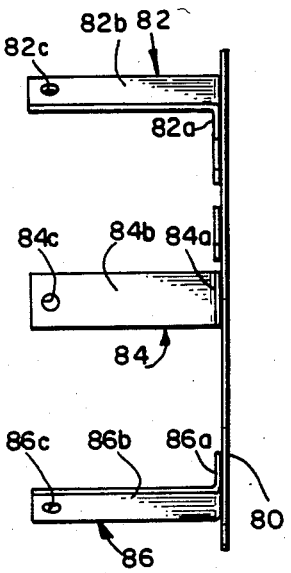

FIGS. 3*a* and 3*b* show plan and side elevations respectively, of a spider employed in the governor assembly of FIG. 2.

Figure 4:
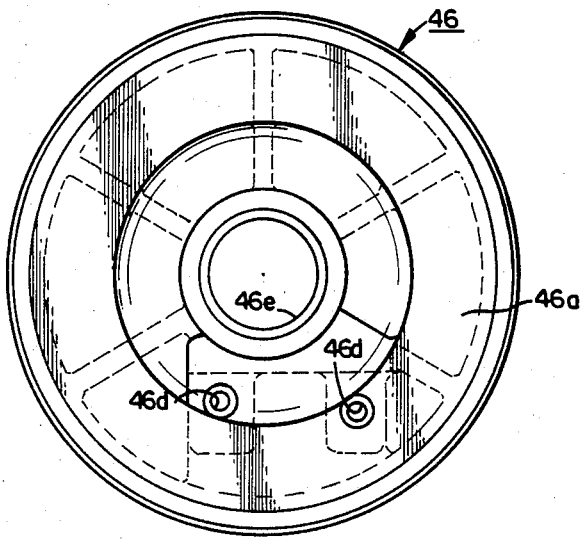

FIG. 4 is an end view of a brake disc employed in the governor of FIG. 2.

Figure 5A:
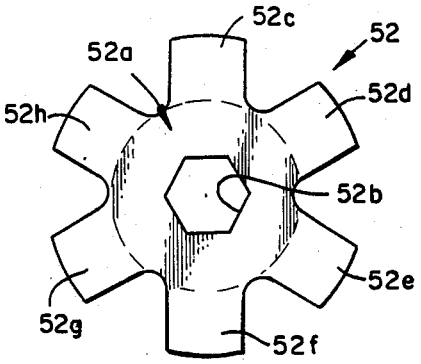
Figure 5B:
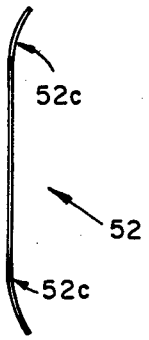

FIGS. 5*a* and 5*b* show plan and end views of one of the spring back-ups of the governor shown in FIG. 2.

Figure 5C:
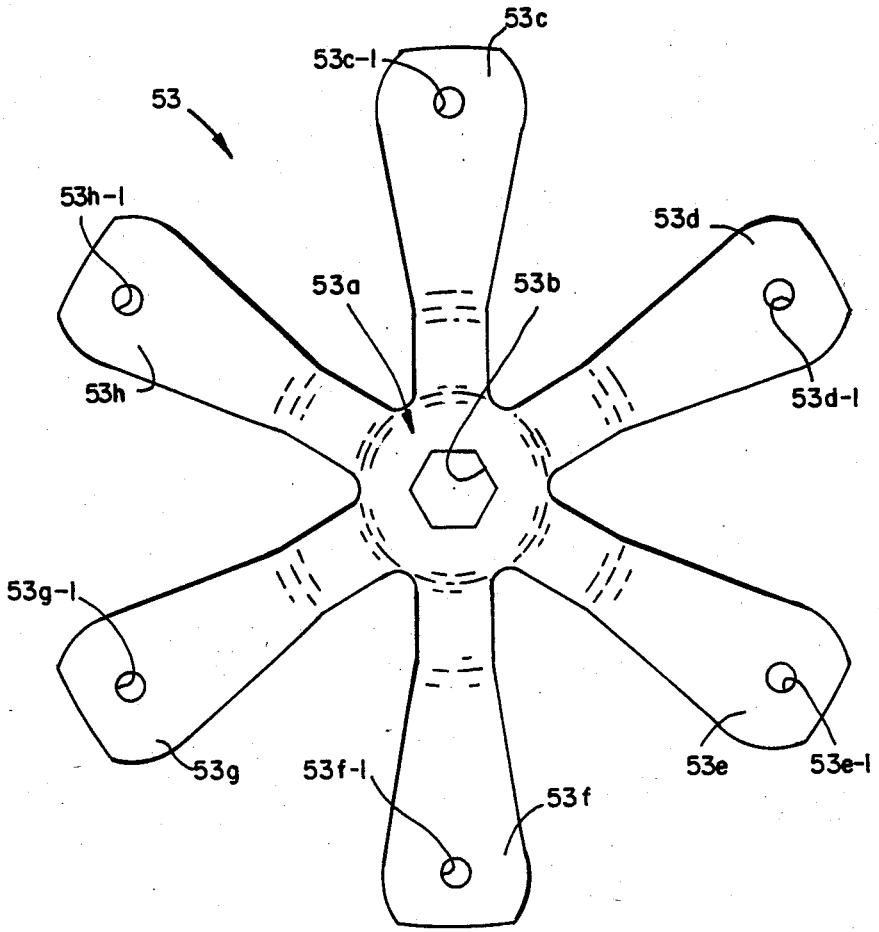
Figure 5D:
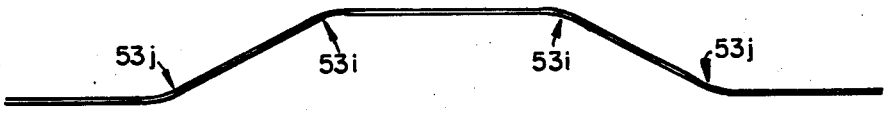

FIGS. 5*c* and 5*d* show plan and end views of the governor springs shown in FIG. 2.

Figure 6:
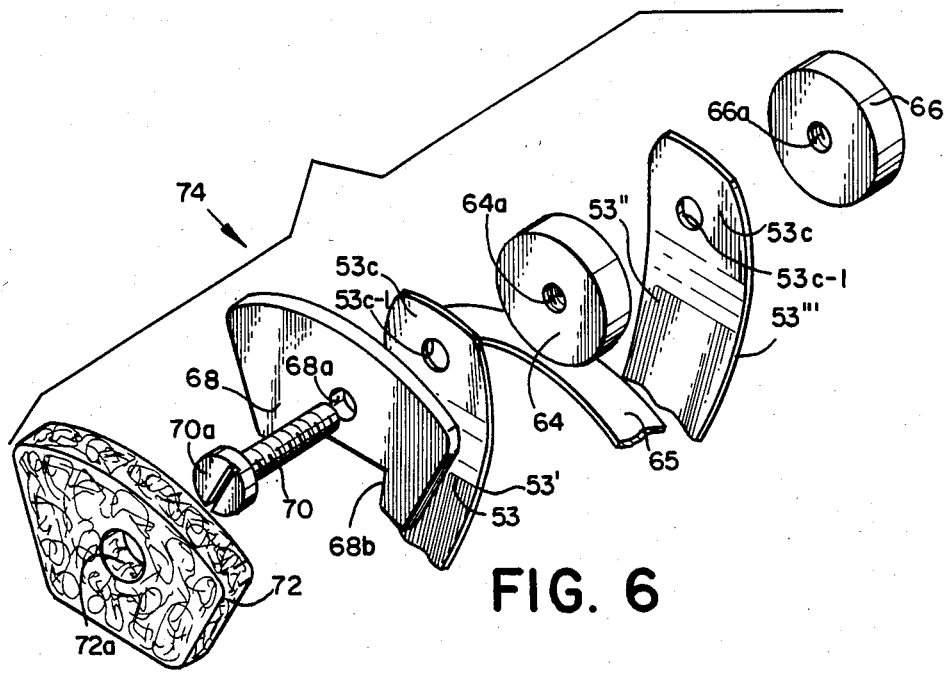

FIG. 6 is an exploded perspective view showing the brake pad and spacer assembly of FIG. 2 in greater detail.

Figure 6A:
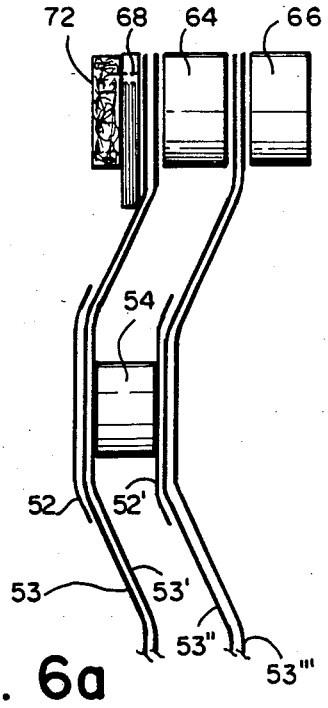

FIG. 6*a* shows an end view of the assembly of governor springs and spring back-ups employed in the governor of FIG. 2.

Figure 7:
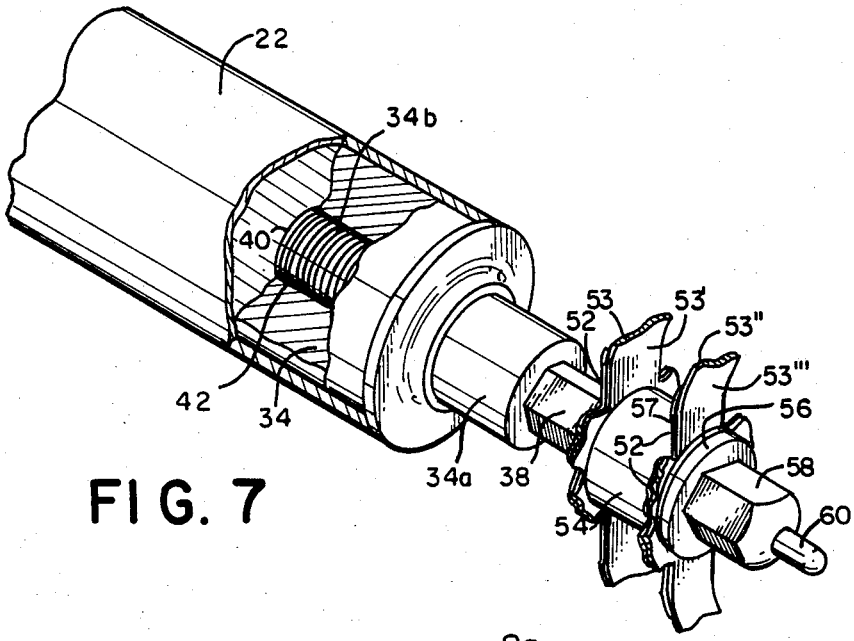

FIG. 7 is a partially exploded perspective view showing the shaft sub-assembly of the governor assembly of FIG. 2 in greater detail.

Figure 8A:
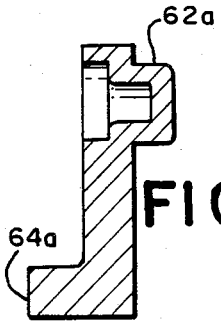
Figure 8B:
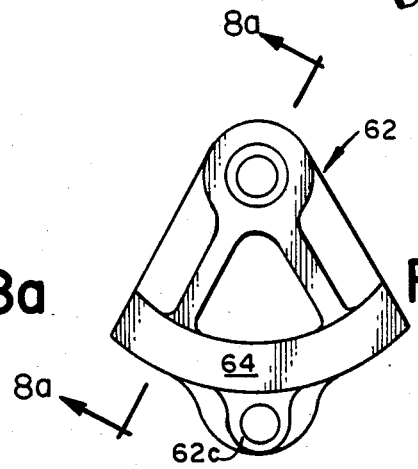
Figure 8C:
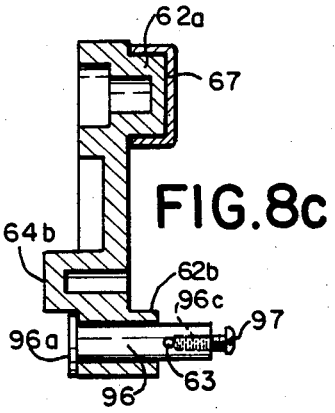
Figure 8D:
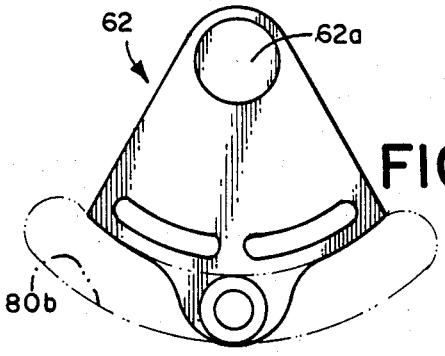

FIGS. 8*a* and 8*c* are sectional views and FIGS. 8*b* and 8*d* show front and rear plan views respectively, of the cam assembly employed in the governor assembly of FIG. 2.

Figures 9, 10A, 10B, 10C, 10D:
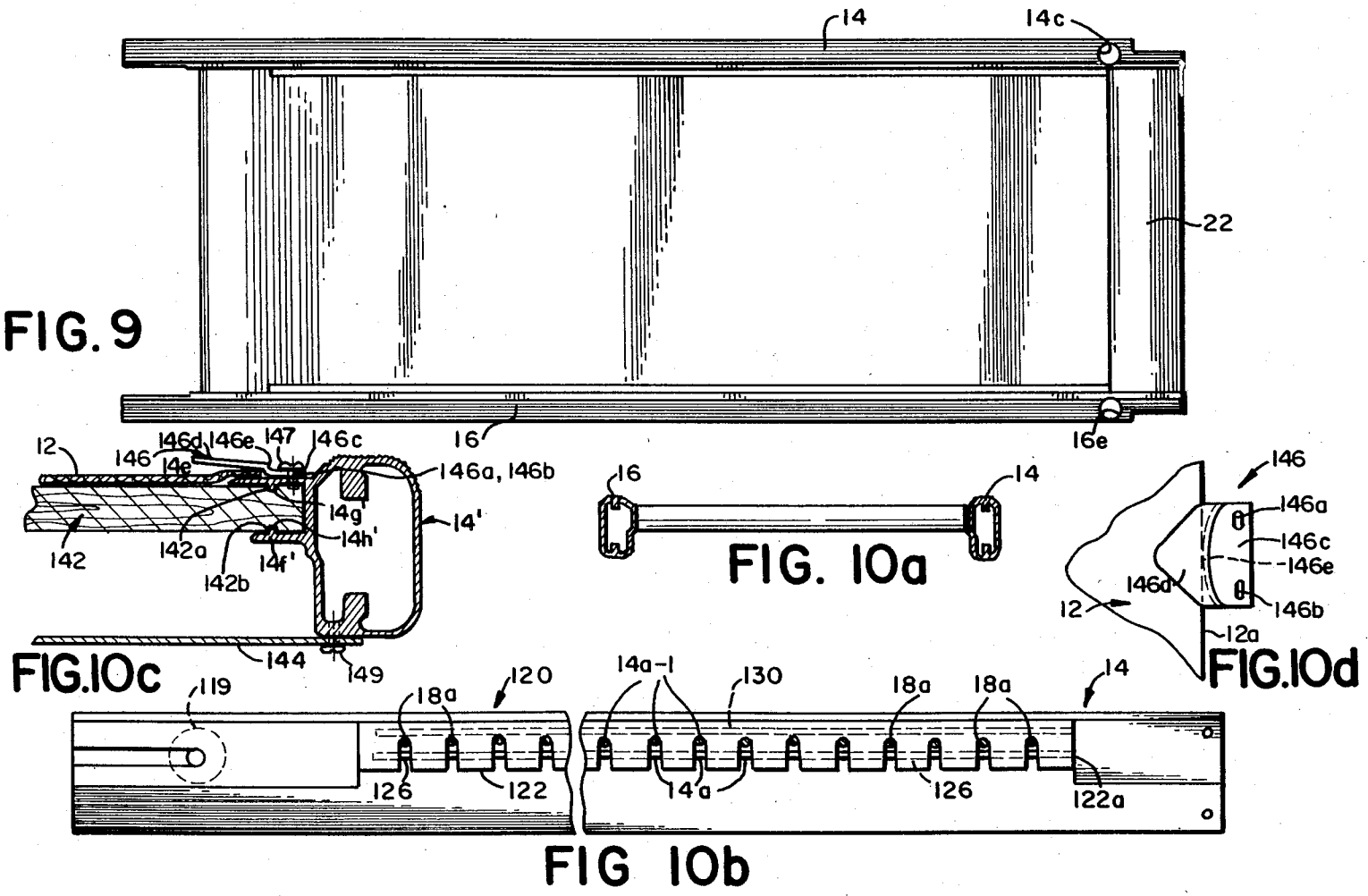

FIG. 9 shows a top plan view of the frame assembly employed in the treadmill assembly of FIG. 2.

FIGS. 10*a* and 10*b* show end and side views of the frame as shown in FIG. 9.

FIG. 10*c* is an enlarged sectional view of an alternative embodiment of the present invention in which the intermediate rollers are replaced by a stationary slider bed.

FIG. 10*d* is a top plan view of the belt guide shown in FIG. 10*c*.

Figure 11A:
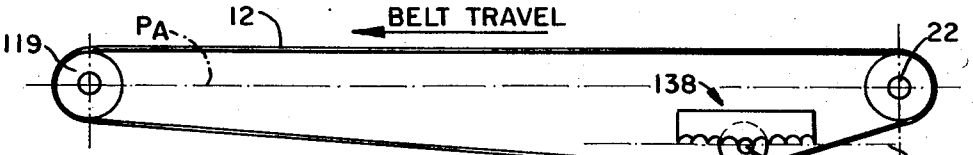
Figure 11B:
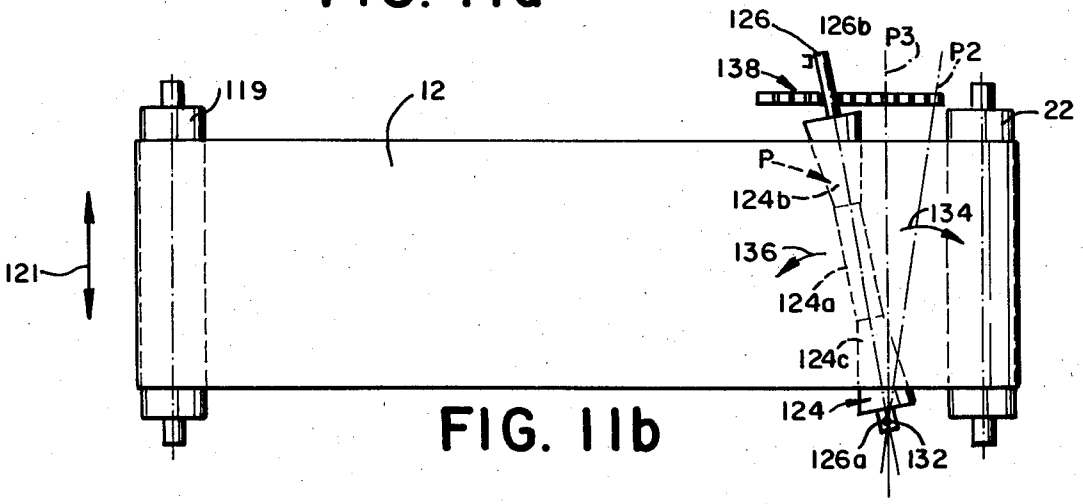
Figure 11C:
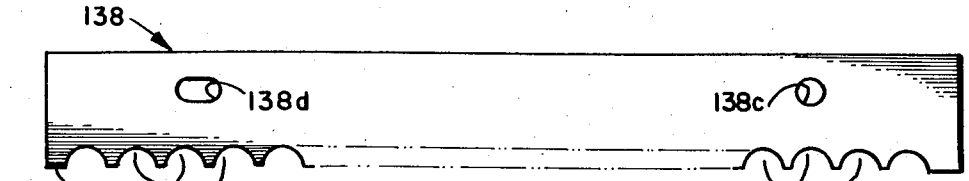

FIGS. 11*a* and 11*b* are top plan and side views of the treadmill showing the belt tracking system and FIG. 11*c* is a detailed plan view of the positioning plate employed in the belt tracking system of FIG. 11*b*.

DETAILED DESCRIPTION OF THE INVENTION

Figure 1:
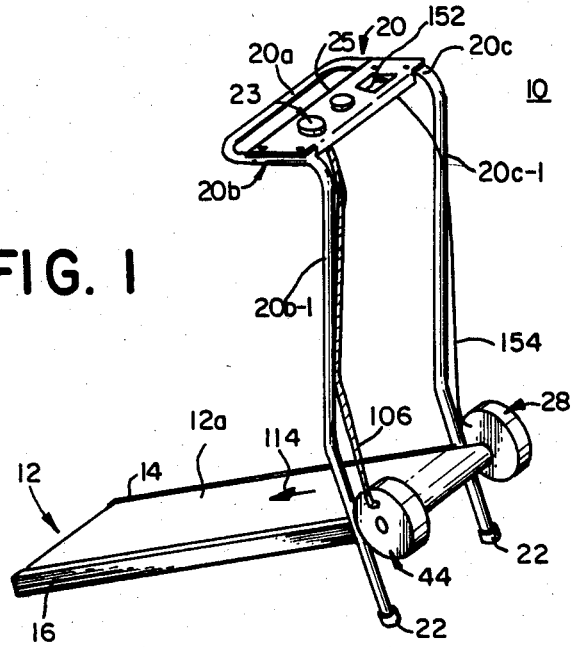
FIG. 1 shows a perspective view of a treadmill assembly designed in accordance with the principles of the present invention.

FIG. 1 shows a treadmill 10 embodying the principles of the present invention and comprised of a treadmill belt 12 arranged between a pair of rails 14 and 16, shown best in FIGS. 9–10*b*. The undersides of the left-hand ends of rails 14 and 16 are designed to rest upon a floor or other suitable supporting surface.

A plurality of rollers 18 (see FIG. 2) are arranged between rails 14 and 16, and have their shafts 18*a*, as shown in FIGS. 2, 10*b* and 11*a*, extending into openings 14*a*, 16*a* provided at spaced intervals along each of the confronting inner surfaces of the roller supporting sections of rails 14 and 16. FIG. 10*b* shows one set of openings 14*a* arranged at spaced intervals along the roller supporting section 122 of rail 14.

U-shaped bar or handle assembly 20 of treadmill 10 is comprised of a yoke portion 20*a* for gripping by a treadmill user, if desired. Downwardly depending portions 20*b*-1 and 20*c*-1 of arms 20*b* and 20*c* terminate in feet covered with rubber-like supporting cups 22, 22. The downwardly depending arm portions 20*b*-1 and 20*c*-1 extend through openings 14*e*, 16*e* in rails 14 and 16, and are secured thereto by suitable fastening means (see FIGS. 1 and 10).

A control panel 21 extending between and secured to arms 20*b*, 20*c* includes a timer having a settable knob 23, an adjustable speed control knob 25 and a speedometer 152. Cable 106 couples speed control knob 25 to the governor assembly as will be more fully described.

As shown in FIGS. 1 and 2, continuous closed loop treadmill belt 12, in addition to encircling rollers 18, encircles a forward-most roller comprised of hollow cylindrical member 22, whose left-hand end receives the right-hand end 24*a* of a support member 24, the end 24*a* being force-fitted into the left-hand end of hollow cylinder 22. Intermediate portion 24*b* of member 24 is journaled within bearing assembly 26, while the left-hand end 24*c* of member 24 extends through the central opening 28*a* in flywheel 28. Washer 30 and fastener 32 secure flywheel 28 to member 24, and hence to roller 22. The bearing 26 is mounted within an opening 27*a* in support member 27, joined to rail 14 by fastener 29.

The right-hand end of hollow cylindrical member 22 forcefittingly receives the left-hand end of hollow shaft supporting member 34, whose right-hand end 34*a* is journaled within bearing assembly 36, which is arranged within opening 46*e* in governor base plate 46 (see FIGS. 2 and 4). Member 34 (note FIG. 7) has a hexagonal-shaped bore 34*d* of a cross-sectional configuration adapted to conform to and slidably receive elongated hexagonal shaft 38. A closure cap 40 closes and seals the left-hand end of the hexagonal-shaped opening in member 34. Helical spring 42 is positioned between cap 40 and the left-hand end of hexagonal shaft 38. Shaft 38 is axially slidable within member 34, and is normally urged to the right by spring 42. The right-hand end of shaft 38 extends into governor assembly 44 comprised of generally circular-shaped base plate 46, which is joined to rail 16 by fasteners 48, 48 extending through openings 46*d* in base plate 46 (see FIG. 4).

A retaining ring 50 is secured within an annular groove 38*c* in shaft 38 intermediate its ends and is engaged by ring-shaped member 51, which engages a first spring back-up 52 (FIGS. 5*a*, 5*b*), having a central portion 52*a* provided with a hexagonal-shaped central opening 52*b* (see FIG. 5*a*). Spring back-up 52 is provided with a plurality of projections 52*c*–52*h*. Each projection of spring back-up 52 is bent to form curved portions 52*c*.

A pair of governor springs 53, 53′ are arranged adjacent spring back-up 52, each governor spring is designed as shown in FIGS. 5*c*, 5*d*. The governor spring 53 has a central portion 53*c* having a hexagonal shaped opening 53*b*. A plurality of integral projections 53*c*–53*h* extend radially outward from central portion 53*a*. Each projection is provided with an opening 53*c*-1 through 53*h*-1. The projections are each bent at 53*i*, 53*j* to form the curved spring configuration shown in FIG. 5*d*. The governor springs 53 and the spring back-up 52 are preferably formed of spring steel. A spacer 54 having a generally cylindrical outer surface and a hexagonal-shaped shollow interior, is placed over shaft 38 and provides the desired spacing between flexible springs 53, 53′ and flexible springs 53″, 53‴ which are substantially identical to flexible springs 53, 53′. A spring back-up 52′ is placed against the left-hand flexible spring 53″. A circular-shaped disk 57 having a hexagonal-shaped recess 57*a* is placed against and receives the right-hand end of shaft 38. The marginal portion of disk 57 rests against governor spring 53‴ and is positioned between the right-hand surface of the central portion 53*a*‴ of spring 53‴ and ring-shaped washer 56, and is retained in place by hexagonal-shaped nut 58, having a threaded portion 58*a*, which threadedly engages the tapped interior portion 38*b* of shaft 38. An elongated button-like cylindrical-shaped member 60 having a low friction bearing surface is force-fitted into the opening in the right-hand end of nut 58 and its rounded top is arranged to slidably engage the diagonally-aligned cam surface 64 of a pivotally mounted cam member 62 shown in FIGS. 2, 8*a*–8*d* and 9. The diagonally-aligned cam surface 64 adjustably controls the position occupied by button 60 by rotation of cam member 62, which in turn determines the position of shaft 38, which is moved either toward the left or toward the right, relative to the position occupied by cam member 62, thereby movably positioning the outer ends of flexible springs 53 through 53‴ relative to annular surface 46*a*.

All of the projections 53*c*–53*h* of flexible springs 53–53‴ shown best in FIGS. 2, 5*d* and 6, receive and support a brake assembly comprised of a cylindrical disk 64 serving as a spacer arranged between spring projections 53*c*, 53*c*′ and 53*c*″, 53*c*‴, a second circular disk 66 arranged against the right-hand surface of spring projection 53*c*‴ and an arcuate shaped plate 68 arranged against the left-hand surface of spring projection 53*c*.

Arcuate plate 68 is provided with a central opening 68*a*. Disks 64 and 66 each have threaded central openings 64*a*, 66*a* for receiving and threadedly engaging threaded fastener 70 to secure the brake assembly comprised of spring projections 53*c*–53*c*‴ disks 64, 66 and arcuate shaped plate 68. The threaded fastening member 70 has a head portion which engages the left-hand surface of plate 68. Plate 68 has a notch 68*b* which receives a portion of a spring arm 53.

An arcuate shaped brake pad 72 is positioned against the left hand surface of plate 68 and is preferably adhesively secured thereto. It should be noted in FIG. 2 that brake pad assembly 74 is provided at the end of each of the flexible projections 73*c*–73*h*. The brake pads 72 are positioned to selectively engage annular surface 46*a* provided inwardly of the periphery of governor base plate 46. The brake pads are preferably formed of felt. Openings 72*a* in the brake pads receive the head 70*a* of a fastener 70 and retain the head beneath surface of the brake pad. The arcuate brake pads 72 significantly increase the braking surface of the braking assembly as compared with the prior art design. The governor assembly 44 is further provided with a metallic stabilizing ring 65 positioned between governor spring 53′ and spring back-up 52′. Ring 65 engages the interior of spaced disks 64. Stabilizing ring 65 prevents resonant twisting of brake springs 53–53‴ during rotation and assures uniform engagement of the brake pads 72 with surface 46*a*.

The governor assembly 44 is covered by a spider 78, shown best in FIGS. 2, 3*a* and 3*b*, which spider is comprised of a cylindrical disk 80 having three L-shaped legs 82, 84, 86, the short leg portions 82*a*, 84*a* and 86*a* being joined to the interior surface of the disk 80, for example, by welding, and the long leg portions 82*b*, 84*b* and 86*b* extending away from disk 80 and toward governor base plate 46. Each of the legs 82–86 is provided with an opening 82*c*, 84*c*, 86*c* at its free end, each of said openings receiving a fastening member 88, which threadedly engages tapped openings, such as for example, tapped openings 46*b*, 46*c* in base plate 46, for securing spider 80 to base plate 46. Opening 80*a* in disk 80 receives boss 62*a* on cam 62 which supports cam member 62 and anchor pin 63 (see FIG. 9). Arcuate shaped opening 80*b* slidably receives projection 62*b* of cam member 62. Opening 80*c* supports post 109 (see FIG. 2) having an opening 108*a* for slidably receiving cable 106. Nut 108*b* secures post 108 to spider 80.

A gasket 90 encircles the periphery of disk 80 and is provided with a continuous groove 90*a* for embracing the peripheral edge of disk 80 (see FIG. 2). An elongated flexible sheet is arranged to rest upon a first shoulder 90*b* provided in gasket 90, and a second shoulder 46*d* arranged about the periphery of base plate 46. Sheet 92 encircles and encloses the governor assembly 44 and is held in this position by an adhesive for example.

The adjustable cam 62 is provided with a mounting boss 62*a* at one end thereof as shown best in FIGS. 2, 8*a*, 8*c* and 9. Boss 62*a* extends through opening 80*a* in disk 80. A push-on cap 67 (See FIG. 8*c*) is force-fitted upon boss 62*a* after boss 62*a* is inserted through opening 80*a*. An anchor pin extends through opening 62*b* at the opposite end of cam 62 and through arcuate shaped opening 80*b* in disk 80. The head 96*a* of anchor pin 96 engages the surface 62*c* surrounding opening 62*b*. The body of anchor pin 96 is provided with an opening 96*b* for receiving flexible cable 106. Threaded opening 96*c* in anchor pin 96 receives a threaded set screw 97 for locking flexible cable 106 in position in opening 96*b*.

Cable 106 extends through an opening 108*a* in post 108 secured to opening 80*c* in spider disk 80 by fastening member 108*b*. The cable extends upwardly along arm 20*b* of U-shaped handle assembly 20, shown in FIG. 1, and has its upper end 106*b* secured to the end of a swingable arm (not shown for purposes of simplicity) of adjustable speed control knob 23 of which is pivotally mounted upon panel 21. By rotating knob 23, cable 106 is moved respectively up or down, causing the swinging movement of lever cam 62, by means of anchor pin 96 which extends through opening 80*a* in spider disk 80, as shown best in FIG. 2, in order to rotate cam 62. Cam surface 64 comprises a planar ramp surface whose high end 64*a* is shown in FIG. 8*a* and whose low end 64*b* is shown in FIG. 8c. The angular position of cam 62, which is adjustably rotated about the axis of boss 62a, controls the axial position of button 60 and hence governor springs 53–53'''.

The position of rotatable cam 62 controls the positioning of button 60 and hence flexible arms 53–53''' and brake shoes 72 relative to the cooperating stationary surface 46a.

The governor 44 assembly operates as follows:

A person standing upon the treadmill belt 12 may either walk or run in the "uphill" direction, i.e., in a direction from the left toward the right, relative to FIG. 1, causing the upper run 12a of treadmill belt 12 to move in the direction shown by arrow 114. The treadmill belt engages and imparts frictional drive to hollow cylindrical roller 22, causing it to rotate. Member 34 and hexagonal shaft 38 rotate together with hollow cylindrical roller 22, causing the rotation of flexible springs 53–53'''. The radial projections of flexible springs 53–53''' develop a centrifugal force, the magnitude of which controls the deflection of the diagonal portions of the projections between curved portions 53i–53j (see FIG. 5d) towards the left (relative to FIG. 2), the greater the angular velocity, the greater the deflection. As the angular velocity and hence the amount of deflection increases, the brake pads 72, mounted upon the ends of the projections on springs 53–53''' engage stationary annular surface 46a and impart drag upon the rotation of the springs 53–53''' to limit the angular velocity of roller 22 and hence treadmill belt 12. By adjusting cam member 62 to move shaft 38 further toward the right, the drag imposed upon treadmill belt 12 by the governor assembly 44 is reduced or even removed, allowing the treadmill to move at a faster rate. Conversely, by moving cam member 62 to move shaft 38 further toward the left and against the force of spring 42, the maximum speed of treadmill belt 12 is decreased.

Due to the unique shape of the integral projections of flexible springs 53–53''', the outward radial movement of the brake assemblies 74 is minimal, providing a governor assembly of small, compact size, most of the movement of the brake assembly 74 occurring in a direction substantially parallel to the axis of rotation of the blades. The stabilizing ring 65 prevents the projections 53c–53h from resonant twisting during operation.

The housing of the governor assembly is arranged to be easily and readily removed and replaced to simplify the periodic removal and replacement of the brake pads 72.

As was mentioned hereinabove, treadmill belt 12 is supported by drive roller 22 and a plurality of closely-spaced rollers 18. Each roller 18 is mounted upon a shaft 18a, Ithe free ends of which extend outwardly from the free ends of the roller 18. The rails 14 and 16 are provided with an intermediate portion 120, shown best in FIGS. 10b and 11a–11c, said intermediate portion having an elongated hollow rectangular-shaped roller shaft supporting section 122, extending inwardly from each rail, such as for example, the rail 14 shown in FIGS. 10b. The simple and yet reliable manner in which the rollers 18 are mounted to the rails 14, 16 is described in detail in copending application Ser. No. 517,079 filed July 25, 1983 and now U.S. Pat. No. 4,544,152, issued Oct. 1, 1985, and a detailed description will be omitted for purposes of simplicity.

A belt tracking system, shown in FIGS. 11a and 11b is provided to maintain proper alignment of belt 12. In the event that belt 12 stretcher in a non-uniform manner and/or moves laterally in either lateral direction as shown by double headed arrow 121 due to irregularities in belt 12, the belt tracking system shown in FIGS. 11a, 11b and comprised of swingably mounted roller 124, is provided to correct for such irregularities. The rollers 22 and 119 have their axes of rotation arranged in spaced parallel fashion and lying in a common imaginary plane $P_A$. Roller 124 has its axis of rotation swingable substantially in an imaginary plane $P_B$ displaced from the imaginary plane $P_A$.

Roller 124 is provided with an "hour-glass" configuration defined by central cylindrical portion 124a of a first smaller diameter and outer tapered truncated conical shaped portions 124b, 124c having smaller diameter ends equal in diameter to central portion 124a and each joined to an adjacent end of the central portion 124a. The portions 124b, 124c taper outwardly to form larger diameter ends at the outer ends of portions 124b, 124c. The portions 124a–124c are fixedly secured to one another and are freewheelingly mounted upon an elongated shaft 126. One end 126a of shaft 126 is pivotally mounted to rail 16 enabling shaft 126 and roller 124 to swing either clockwise or counterclockwise about pivot point 132, as shown by arrows 134, 136, respectively.

An elongated plate 138 (see FIG. 11c) is secured to rail 14 and is provided with a plurality of downwardly facing semi-circular shaped notches 138b arranged at spaced intervals along the bottom edge 138a of plate 139. Openings 138c, 138d receive suitable fastening members (not shown) for securing plate 138 to rail 14.

The diameter of notches 138b is substantially equal to the diameter of shaft 126 and the end 126b of shaft 126 is adapted to be received by one of the notches 138b with the selected notch being determined by the condition of belt 12.

For example, if belt 12 is experiencing lateral movement upwardly (relative to FIG. 11b) for example, due to non-uniform stretching roller 124 is moved to the position P shown in FIG. 11b. If belt 12 is experiencing lateral movement downwardly (relative to FIG. 11b) roller 124 may be swung clockwise to the position shown by dotted line $P_2$. If the belt is not experiencing any lateral movemment, the roller 124 may occupy the position represented by dotted line $P_3$.

Roller 124 is maintained in the desired angular position within the selected notch 138b by belt 12 whose lower run passes beneath roller 124 to urge roller 124 upwardly so that end 126b of shaft 126 remains in the selected semi-circular notch.

Roller 124 may be placed in a different position simply by pushing downwardly on shaft end 126b until shaft 126 is clear of the previously selected notch 138b and then swinging roller 124 clockwise or counterclockwise generally in plane $P_B$ and into alignment with the proper notch 138b. The shaft 126 may then be released, enabling belt 12 to exert an upward force which is sufficient to maintain shaft 126 in the selected notch.

The flywheel 28 is mounted within a housing 140 (see FIG. 2). A plurality of permanent magnets 142 are arranged at spaced intervals along surface 28b of flywheel 28. A coil 144 (or other sensor sensitive to a changing magnetic field) is secured to one are of an angle bracket 145 by fastener 145a. Fastener 145b secures the other arm of bracket 145 to support member 27. As the permanent magnets pass coil 144, during rotation of flywheel 28, an alternating current is generated in coil 144. Circuit 143 (see FIG. 2a) including coil 144, diode 148 and capacitor 150 is electrically coupled to a speedometer 17 comprised of milliammeter 152 arranged on the control panel. A pair of conductors 154 extend from circuit 143 to milliammeter 152. The milliammeter 152 is provided with graduations 152*a* which cooperate with "needle" 152*b* to provide readings directly in miles per hour (m.p.h.) for example.

The rollers intermediate forward roller 22 and rearward roller 119 (see FIG. 11*a*) may be replaced by a stationary slider bed comprised of a rigid planar sheet which may, for example, be a sheet of wood (such as plywood or some sheet of suitable lumber) or may comprise a rigid and yet light-weight sheet of metal (i.e. aluminum) or plastic.

The rails 14, 16 are appropriately modified to support the stationary slider bed. For example, FIG. 10*c* shows a modified rail 14' in cross-section. Rail 14' differs from rail 14 shown in FIG. 10*a* with the provision of integral parallel arms 14*e'*, 14*f'*. Each arm 14*e'*, 14*f'* runs the length of rail 14' (note, for example, FIG. 9) and is provided with an integral projection 14*g'*, 14*h'*.

A stationary bed 142 comprised of a sheet of suitable rigid material extends between rails and is of a width sufficient to be received between the cooperating arms 14*e'*, 14*f'* of rail 14 and like cooperating arms of a rail similar in design to rail 14' and substituted for the rail 16, as shown in FIGS. 9 and 10*a*. The length of the sheet 142 is sufficient to extend to a forward location adjacent to the roller 22 and a rearward location adjacent to roller 119.

Sheet 142 is provided with recesses 142*c*, 142*b* adapted to L slidably receive projections 14*g'* and 14*h'* as shown in FIG. 10*c*. At least one tie bar 144 extends across the treadmill and beneath the rails. FIG. 10*c* shows one end of the bar 144 secured to the underside of rail 14' by fastener 149.

FIG. 10*c* shows only one rail and portions of the stationary slide bed, tie bar andbelt for purposes of simplicity, it being understood that the other rail is substantially the mirror image of rail 14' and that the sheet 142 is received by arms provided on the omitted rail in the same manner as shown by sheet 142 and arms 14*e'*, 14*f'* in FIG. 10*c*. Likewise, the opposite end of tie bar 144 is joined to the underside of the omitted rail in a manner similar to that shown in FIG. 10*c*.

Tie bar 144 limits displacement of the rails relative to one another and also aids in holding the sheet 142 in place.

The belt 12 slidingly engages and is supported by the top surface 142*c* of sheet 142. A guide 146 (see FIGS. 10*c* and 10*d*) has openings 146*a*, 146*b* for receiving fasteners such as 147 for securing guide 146 to arm 14*e'*. The fasteners 147 may extend into sheet 142, if desired.

Guide 146 has a curved intermediate portion 146*e* integral with mounting portion 146c and projecting portion 146*d* whch extends over belt 12. The intermediate portion 146*e* has a curved shaped and presents a convex surface facing the adjacent edge 12*a* of belt 12. The belt guide is positioned on rail 14' several inches away from rear roller 119 and between the front and rear rollers 22 and 119. A similar guide is positioned at a like position upon the omitted rail. The tracking assembly of FIGS. 11*a*–11*c* may be employed with the stationary sliding bed embodiment of FIG. 10*c*. However, the hourglass roller 124 may be replaced by a cylindrical roller, due to the provision of the belt guides.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A governor assembly for use in treadmills and the like, comprising a rotatable axially movable member;

a governor spring mounted for rotation in said rotatable member;

bias means for normally biasing said rotatable axially movable member in a first direction;

said rotatable axially movable member having a free end;

a pivotally-mounted cam member movable between first and second end positions and having a diagonally-aligned cam surface engageable with the free end of said rotatable axially movable member and limiting movement thereof in said first direction in accordance with the angular orientation of said cam member between said first and second end positions;

said spring having a plurality of flexible integral projections each extending radially outward from the axis of rotation of the governor spring;

each projection having at least one intermediate arm portion extending diagonally outwardly from said axis of rotation;

a brake pad secured to the free end of each of said projections;

said diagonally-aligned intermediate portions forming an angle with the imaginary rotational axis of said governor spring of less than 90°, when said governor spring is stationary, said projections being urged in a direction to increase said angle as a function of increasing rotational speed of said governor spring, the free ends of said projections defining a circular path;

a stationalry member having an annular surface surrounding the imaginary axis of rotation of said projections and positioned a spaced distance from the brake pads on said projections when said governor spring is stationary and adapted to be engaged by sasid brake pads when said governor spring is rotated at a predetermined angular velocity, the value of said angular velocity being a function of the spacing between the brake pads and the stationary surface when the governor spring is statinary, being adjusted by said cam member.

2. The apparatus of claim 1, wherein said flexible governor spring comprises a pair of flexible governor springs having their centers joined to said rotatable member;

spacer members arranged between the free ends of associated projections;

said brake pad being joined to the surfce of the projection positioned closer to said annular surface.

3. The apparatus of claim 1 further comprising a removable cover assembly enclosing said governor spring;

said cam member having one end extending through an opening in one surface of said cover assembly to swingably mount the cam member to the cover assembly;

said cam member having a second end extending through an arcuate opening in said one surface for limiting the swinging movement of said second end;

an operating member arranged at a position remote from said cam member;

said cam surface being an arcuate surface arranged between said first and second ends;

a cable joined between said operating member and the second end of said pivotally-mounted cam member for adjustably pivoting said cam member.

4. The apparatus of claim 1 further comprising a spring back-up engaging and rotatable with the governor spring for reinforcing the governor spring projections.

5. The apparatus of claim 1 further comprising two pairs of governor springs, said pairs being spaced apart by first spacer means on said rotatable member;

a plurality of second spacer means arranged between the associated projections of said pairs of governor springs.

6. The apparatus of claim 5 further comprising a pair of spring back-up members each engaging one of the governor springs of each pair of governor springs for reinforcing the governor spring projections.

7. The apparatus of claim 6 wherein said governor springs and spring back-up members are formed of spring steel.

8. The apparatus of claim 1 wherein said brake pads each comprise an arcuate shaped member extending beyond the sides of said projections for providing a large surface area for braking.

9. The appartus of claim 5 further comprising a metallic ring arranged between said two pairs of governor springs and adjacent the spacer means for preventing resonant non-uniform flexing of the projections during rotation.

10. The apparatus of claim 1 further comprising a flywheel member joined to the end of the rotatable member opposite the governor spring;

magnetic field altering means mounted on said flywheel;

an enclosure covering said flywheel;

sensing means mounted on said enclosure and cooperating with said field altering means for generating an electric signal which varies as a function of the rotating speed of said flywheel;

a meter coupled to said sensor for providing a reading responsive to the level of said electrical signal.

* * * * *

UNITED STATES PATENT AND TRADEMARK OFFICE

CERTIFICATE OF CORRECTION

PATENT NO. : 4,659,074

DATED : April 2I, I987

INVENTOR(S) : Charles M. Taitel, Janice B. Taitel

It is certified that error appears in the above-identified patent and that said Letters Patent is hereby corrected as shown below:

IN THE CLAIMS

Column 10, Claim 1, line 39, change "stationalry" to --stationary--.
line 44, change "sasid" to --said--.

Signed and Sealed this

Twenty-ninth Day of September. 1987

*Attest:*

DONALD J. QUIGG

*Attesting Officer* *Commissioner of Patents and Trademarks*